US011092090B1

(12) United States Patent
Balding

(10) Patent No.: US 11,092,090 B1
(45) Date of Patent: Aug. 17, 2021

(54) MULTILINK CRANKTRAINS WITH COMBINED ECCENTRIC SHAFT AND CAMSHAFT DRIVE SYSTEM FOR INTERNAL COMBUSTION ENGINES

(71) Applicant: GM GLOBAL TECHNOLOGY OPERATIONS LLC, Detroit, MI (US)

(72) Inventor: Andrew G. Balding, Wixom, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 17/037,942

(22) Filed: Sep. 30, 2020

(51) Int. Cl.
*F02D 15/02* (2006.01)
*F02B 75/04* (2006.01)

(52) U.S. Cl.
CPC ..... *F02D 15/02* (2013.01); *F02B 75/048* (2013.01); *F01L 2820/032* (2013.01); *F02B 75/041* (2013.01); *F02B 75/047* (2013.01)

(58) Field of Classification Search
CPC ..... F02D 15/00; F02D 15/02; F02B 75/041; F02B 75/047; F02B 75/048; F01L 2820/032; F01L 1/02; F01L 1/04; F01L 1/044; F01B 31/14
See application file for complete search history.

(56) References Cited

U.S. PATENT DOCUMENTS 4,174,683 A 11/1979 Howard
4,873,947 A * 10/1989 Ryan, III ..... F02B 75/041 123/78 C
6,672,270 B2 * 1/2004 Armer ..... F02B 75/04 123/188.4
7,481,199 B2 * 1/2009 Nakamura ..... F01L 13/0026 123/345
7,966,980 B2 6/2011 Lee et al.
8,794,200 B2 8/2014 Jacques et al.
10,125,679 B2 11/2018 Zahdeh
10,190,450 B2 1/2019 Balding
10,428,863 B2 10/2019 Zandeh
10,458,290 B2 10/2019 Balding
2005/0241611 A1 * 11/2005 Weber ..... F02B 37/013 123/299
2005/0284444 A1 * 12/2005 Sherman ..... F02B 69/02 123/316
2019/0323390 A1 10/2019 Balding et al.
2020/0248637 A1 8/2020 Heinbuch et al.

* cited by examiner

*Primary Examiner* — Grant Moubry
*Assistant Examiner* — James G Moubry
(74) *Attorney, Agent, or Firm* — Quinn IP Law

(57) ABSTRACT

Presented are variable compression ratio and independent compression and expansion engines, methods for making/operating such engines, and vehicles equipped with such engines. An engine assembly includes an engine block with a cylinder bore defining a combustion chamber, and a piston movable within the cylinder bore. A valve assembly, which is fluidly coupled to the combustion chamber, selectively introduces/evacuates fluid from the combustion chamber. A crankshaft is supported by the engine block and rotatable on a first axis. A multipoint linkage, which drivingly engages the piston to the crankshaft, rotates on a second axis offset from the first axis. A control shaft is supported by the engine block and rotates on a third axis offset from the first and second axes. The control shaft operable to selectively rotate the multipoint linkage on the second axis, and is operable to selectively unseat the valve assembly.

20 Claims, 2 Drawing Sheets

MULTILINK CRANKTRAINS WITH COMBINED ECCENTRIC SHAFT AND CAMSHAFT DRIVE SYSTEM FOR INTERNAL COMBUSTION ENGINES

INTRODUCTION

The present disclosure relates generally to engine assemblies. More specifically, aspects of this disclosure relate to internal combustion engines with multilink cranktrains for variable compression ratio and independent compression and expansion.

Current production motor vehicles, such as the modern-day automobile, are originally equipped with a powertrain that operates to propel the vehicle and power the vehicle's onboard electronics. In automotive applications, for example, the vehicle powertrain is generally typified by a prime mover that delivers driving torque through an automatic or manually shifted power transmission to the vehicle's final drive system (e.g., differential, axle shafts, road wheels, etc.). Automobiles have historically been powered by a reciprocating-piston type internal combustion engine assembly due to its ready availability and relatively inexpensive cost, light weight, and overall efficiency. Such engines include compression-ignited (CI) diesel engines, spark-ignited (SI) gasoline engines, two, four, and six-stroke architectures, and rotary engines, as some non-limiting examples. Hybrid electric vehicle (HEVs) and full electric vehicles (FEVs), on the other hand, utilize alternative power sources to propel the vehicle and, thus, minimize or eliminate reliance on a fossil-fuel based engine for tractive power.

A common "overhead valve" internal combustion engine includes an engine block with a succession of internal cylinder bores, each of which has a piston reciprocally movable therein. Coupled to a top surface of the engine block is a cylinder head that cooperates with the piston and cylinder bore to form a variable-volume combustion chamber. These reciprocating pistons are used to convert pressure—generated by igniting a fuel-and-air mixture inside the combustion chamber—into rotational forces to drive the engine's crankshaft. The cylinder head defines intake ports through which air, provided by an intake manifold, is selectively introduced into each combustion chamber. Also defined in the cylinder head are exhaust ports through which exhaust gases and byproducts of combustion are selectively evacuated from the combustion chambers to an exhaust manifold. The exhaust manifold, in turn, collects and combines the exhaust gases for metered recirculation into the intake manifold, delivery to a turbine-driven turbocharger, or evacuation from the vehicle via an exhaust system.

A traditional cylinder head houses the engine's valve train, which may include inlet valves, exhaust valves, rocker arms, pushrods, and, in some instances, one or more camshafts. For overhead valve (OHV) designs, the cylinder head may also house the engine's spark plugs and fuel injectors. The valve train is part of the powertrain subsystem responsible for controlling the amount of fuel-entrained air entering, and combustion-related exhaust gases exiting, the engine's combustion chambers at any given point in time. Engine torque and power output is varied by modulating valve lift and timing, which is accomplished by driving the inlet and exhaust valves, either directly or indirectly, by cam lobes on a rotating camshaft. Different engine speeds typically require different valve timing and lift for optimum performance. Generally, low engine speeds require valves to open a relatively small amount over a shorter duration, while high engine speeds require valves to open a relatively larger amount over a longer duration for optimum performance.

Four-stroke combustion engines commonly operate—as the name suggests—in four distinct stages or "strokes" to drive the engine's crankshaft. At one such (first) stage of operation, referred to as the "intake stroke," a metered mixture of fuel and air is introduced into each cylinder as the corresponding piston travels rectilinearly from top-to-bottom along the length of the cylinder bore. Engine intake valves are opened such that a vacuum pressure generated by the downward-travelling piston draws air into the combustion chamber. At the end of this cycle, a metered quantity of finely atomized fuel is introduced into the chamber via a fuel injector. During a subsequent (second) stage, labelled the "compression stroke," the intake and exhaust valves are closed as the piston travels from bottom-to-top and concomitantly compresses the fuel-air mixture. Upon completion of the compression stroke, another (third) stage or "power stroke" commences and a spark plug ignites the compressed fuel and air, with the resultant explosive expansion of gases pushing the piston back to bottom dead center (BDC). During a successive stage—more commonly referred to as the "exhaust stroke"—the piston once again returns to top dead center (TDC) with the exhaust valves open; the travelling piston expels the spent air-fuel mixture from the combustion chamber. To complete the four strokes of a single working (Otto) cycle requires two revolutions of the crankshaft.

SUMMARY

Presented herein are variable compression ratio (VCR) and independent compression and expansion (ICE) engines, methods for making and methods for operating such engines, and motor vehicles with an internal combustion engine having a multilink cranktrain with a combined eccentric shaft and camshaft drive system. By way of example, a VCR/ICE engine assembly includes a multilink cranktrain that combines both a VCR eccentric shaft and a valve train camshaft into a single cranktrain control shaft. The cranktrain control shaft drivingly engages serially aligned multi-point linkage assemblies that couple the pistons and piston rods with the crankshaft to enable a variable-length, four-stroke Atkinson cycle. An optional VCR/ICE phasing device selectively changes the rotational displacement or phasing of the cranktrain control shaft relative to the engine's crankshaft and, in so doing, changes the clearance volume within the combustion chamber above the piston. In addition to facilitating VCR and ICE, the cranktrain control shaft also provides intake/exhaust valve timing and control by engaging the pushrods and hydraulic followers of an overhead valve train. This engine architecture packages the cranktrain control shaft within the engine block, horizontally adjacent the cylinder bore, rather than packing a dedicated VCR eccentric shaft in the crankcase underneath the crankshaft and separately packing a dedicated camshaft in the cylinder head above the engine block.

Integrating the valve train drive system and VCR/ICE drive system into a common control shaft reduces engine part count and simplifies manufacturing, resulting in notable time and cost savings. In addition, internal combustion engines with variable compression ratio and independent compression and expansion capabilities enable a four-stroke Atkinson cycle in which the compression stroke length may be selectively varied from the expansion stroke length during both high-load, high-speed engine operating conditions and low-load, low-speed engine operating conditions to realize increased fuel economy benefits. Moreover, incorporation of a pushrod-type valve train assembly leads to quieter engine operation, longer engine life, and eliminates the need for periodic adjustment of valve clearance. Other attendant benefits may include reduced system complexity and mitigated internal friction losses, as well as decreases in engine size and mass with corresponding reductions in packaging space and gross vehicle weight (GVW).

Aspects of this disclosure are directed to reciprocating-piston type internal combustion engine assemblies with VCR and ICE capabilities. For instance, an engine assembly includes an engine block that defines—singly (e.g., in monobloc designs) or collectively with a cylinder head (e.g., block-and-head designs)—one or more internal combustion chambers each with a cylinder bore. A piston is slidably mounted within each cylinder bore, reciprocally movable along a rectilinear centerline of the bore. A valve assembly, which may include one or more exhaust and/or intake valves with corresponding rockers, pushrods, and hydraulic followers, is fluidly coupled to each combustion chamber. Each intake/exhaust valve is operable to sealingly seat and selectively unseat to thereby introduce or evacuate a fluid from the combustion chamber.

Continuing with the discussion of the above example, an engine crankshaft is rotatably supported by the engine block, e.g., by main bearings, and is rotatable on a first (crank) axis to output torque generated by the engine. The engine assembly also includes one or more multipoint linkages, each of which rotates on the crankshaft and drivingly engages a respective piston to the crankshaft. The multipoint linkage is rotatable on a second (link) axis that is radially offset from and substantially parallel to the rotational axis of the crankshaft. A control shaft (or multiple control shafts for "twin-cam" configurations) is rotatably supported by the engine block, e.g., by simple bearings, and is rotatable on a third (control) axis that is horizontally and vertically offset from and substantially parallel to the first and second axes. This control shaft is drivingly coupled, e.g., via a tie-link rod, to the multipoint linkage(s) and operable to selectively rotate the linkage(s) on the crankshaft. The control shaft is also coupled, e.g., via roller cams, to the valve assembly and operable to selectively unseat the intake/exhaust valves.

Additional aspects of this disclosure are directed to motor vehicles with internal combustion engines having multilink cranktrains with combined eccentric shaft and camshaft drive systems. As used herein, the terms "vehicle" and "motor vehicle" may be used interchangeably and synonymously to include any relevant vehicle platform, such as passenger vehicles (ICE, HEV, fuel cell, fully and partially autonomous, etc.), commercial vehicles, industrial vehicles, tracked vehicles, off-road and all-terrain vehicles (ATV), motorcycles, farm equipment, trains, watercraft, aircraft, etc. Disclosed concepts are applicable to automotive and non-automotive applications alike, including stationary power generators and pumping equipment. In an example, a motor vehicle includes a vehicle body with a passenger compartment, multiple road wheels, and other standard original equipment. The vehicle powertrain includes an internal combustion engine assembly that is mounted to the vehicle body, e.g., inside an engine bay, and outputs torque to select road wheels, e.g., via a multi-speed transmission, to propel the vehicle.

Continuing with the discussion of the above example, the engine assembly includes an engine block that at least partially defines therein a combustion chamber with a cylinder bore; a piston is reciprocally movable within the cylinder bore. A valve assembly is fluidly coupled to the combustion chamber and operable to selectively unseat to thereby introduce and/or evacuate a fluid from the combustion chamber. The engine also includes a crankshaft that is rotatably supported by the engine block and rotatable on a first axis. A multipoint linkage, which is rotatable on a second axis offset from the first axis, drivingly engages the piston to the crankshaft. The engine further includes a control shaft that is rotatably supported by the engine block and rotatable on a third axis offset from both the first and second axes. This control shaft is coupled to and operable to selectively rotate the multipoint linkage on the second axis. The control shaft is also operatively coupled to and operable to selectively unseat the valve assembly.

Aspects of this disclosure are directed to methods for assembling and methods for operating disclosed engines, powertrains, and vehicles. In an example, a method is presented for manufacturing an internal combustion engine. This representative method includes, in any order and in any combination with any of the above and below disclosed options and features: receiving an engine block defining therein a combustion chamber with a cylinder bore; attaching a valve assembly to the engine block, the valve assembly being fluidly coupled to the combustion chamber and operable to selectively unseat to thereby introduce and/or evacuate a fluid from the combustion chamber; attaching a piston to the engine block to move reciprocally within the cylinder bore; attaching a crankshaft to the engine block to rotate on a first axis; attaching a multipoint linkage to the engine block, the multipoint linkage drivingly engaging the piston with the crankshaft and rotating on a second axis offset from the first axis; attaching a control shaft to the engine block, the control shaft rotating on a third axis offset from the first and second axes; coupling the control shaft to the multipoint linkage, the control shaft being operable to selectively rotate the multipoint linkage on the second axis; and coupling the control shaft to the valve assembly, the control shaft being operable to selectively unseat the valve assembly.

The above summary does not represent every embodiment or every aspect of this disclosure. Rather, the above features and advantages, and other features and attendant advantages of this disclosure, will be readily apparent from the following detailed description of illustrative examples and modes for carrying out the present disclosure when taken in connection with the accompanying drawings and the appended claims. Moreover, this disclosure expressly includes any and all combinations and subcombinations of the elements and features presented above and below.

Figure 1:
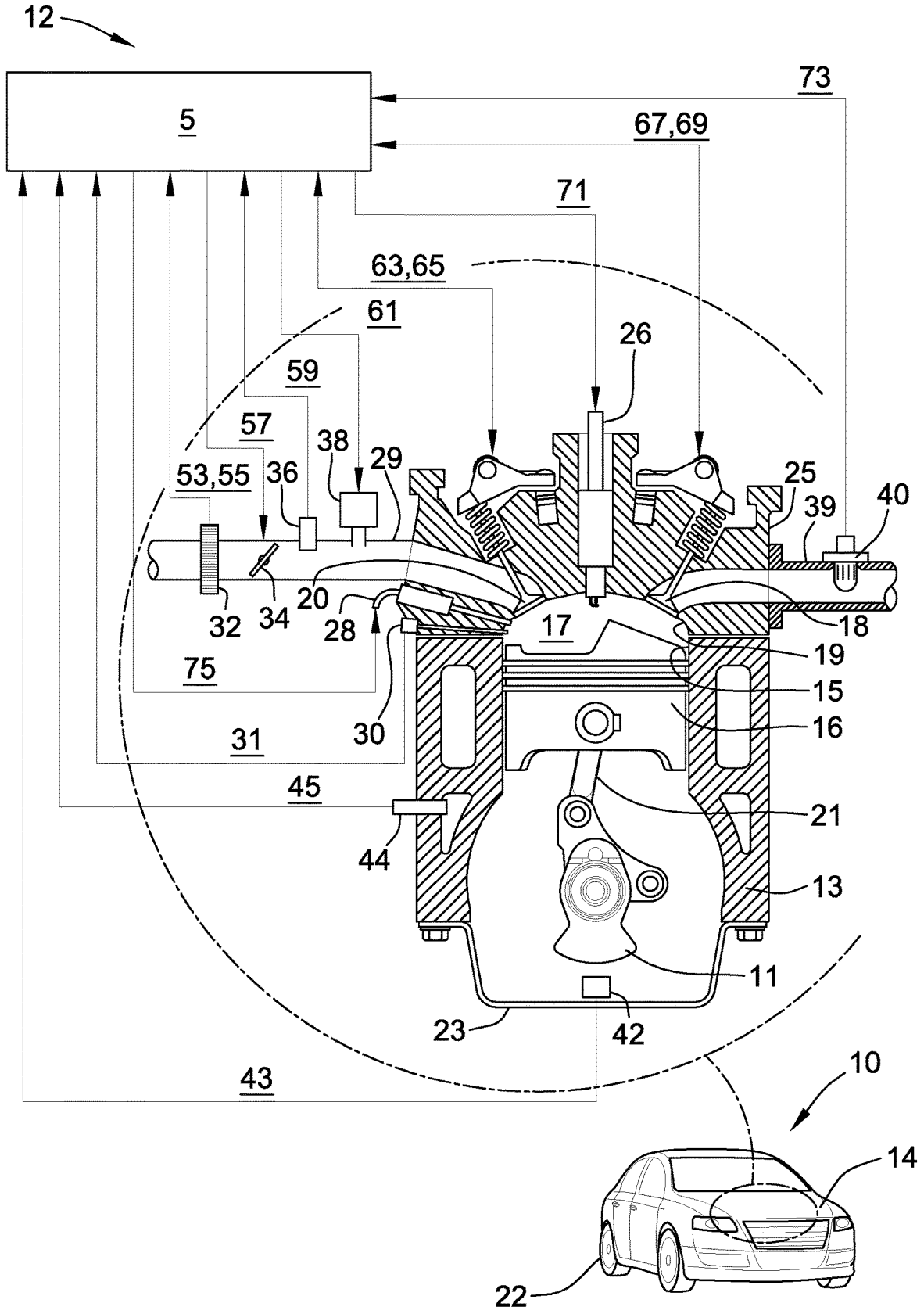
FIG. 1 is a front, perspective-view illustration of a representative motor vehicle with an inset schematic illustration of a representative direct-injection, reciprocating-piston type internal combustion engine assembly with variable compression ratio and independent compression and expansion capabilities in accord with aspects of the present disclosure.

Representative embodiments of this disclosure are shown by way of non-limiting example in the drawings and are described in additional detail below. It should be understood, however, that the novel aspects of this disclosure are not limited to the particular forms illustrated in the above-enumerated drawings. Rather, the disclosure is to cover all modifications, equivalents, combinations, subcombinations, permutations, groupings, and alternatives falling within the scope of this disclosure as encompassed, for instance, by the appended claims.

DETAILED DESCRIPTION

This disclosure is susceptible of embodiment in many different forms. Representative examples of the disclosure are shown in the drawings and herein described in detail with the understanding that these embodiments are provided as an exemplification of the disclosed principles, not limitations of the broad aspects of the disclosure. To that end, elements and limitations that are described, for example, in the Abstract, Introduction, Summary, Description of the Drawings, and Detailed Description sections, but not explicitly set forth in the claims, should not be incorporated into the claims, singly or collectively, by implication, inference, or otherwise. Moreover, the drawings discussed herein may not be to scale and are provided purely for instructional purposes. Thus, the specific and relative dimensions shown in the Figures are not to be construed as limiting.

For purposes of the present detailed description, unless specifically disclaimed: the singular includes the plural and vice versa; the words "and" and "or" shall be both conjunctive and disjunctive; the words "any" and "all" shall both mean "any and all"; and the words "including," "containing," "comprising," "having," and permutations thereof, shall each mean "including without limitation." Moreover, words of approximation, such as "about," "almost," "substantially," "generally," "approximately," and the like, may each be used herein in the sense of "at, near, or nearly at," or "within 0-5% of," or "within acceptable manufacturing tolerances," or any logical combination thereof, for example. Lastly, directional adjectives and adverbs, such as fore, aft, inboard, outboard, starboard, port, vertical, horizontal, upward, downward, front, back, left, right, etc., may be with respect to a motor vehicle, such as a forward driving direction of a motor vehicle, when the vehicle is operatively oriented on a horizontal driving surface.

Referring now to the drawings, wherein like reference numbers refer to like features throughout the several views, there is shown in FIG. 1 a perspective-view illustration of a representative automobile, which is designated generally at 10 and portrayed herein for purposes of discussion as an engine-propelled, sedan-style passenger vehicle. The illustrated automobile 10—also referred to herein as "motor vehicle" or "vehicle" for short—is merely an exemplary application with which novel aspects of this disclosure can be practiced. In the same vein, implementation of the present concepts into a spark-ignited, direct-injection (SIDI) gasoline engine should also be appreciated as an exemplary application of the novel concepts disclosed herein. As such, it will be understood that features of the present disclosure may be applied to other engine configurations, implemented by alternative powertrain architectures, and utilized for any logically relevant type of motor vehicle. Lastly, only select components of the automobile and internal combustion engine have been shown and will be described in additional detail herein. Nevertheless, the vehicles and engines discussed below may include numerous additional and alternative features, and other available peripheral components for carrying out the various methods and functions of this disclosure.

FIG. 1 illustrates an example of a twin-cam, V-type engine assembly 12 that is mounted inside an engine bay 14 of the vehicle body. The illustrated engine assembly 12 is a four-stroke, reciprocating-piston engine configuration that operates to propel the vehicle 10, for example, as a direct injection (DI) gasoline engine, including flexible-fuel vehicle (FFV) and hybrid electric vehicle (HEV) variations thereof. The engine assembly 12 can optionally operate in any of an assortment of selectable combustion modes, including a homogeneous-charge compression-ignition (HCCI) combustion mode and an adjustable-lift spark-ignition (SI) combustion mode. Additionally, the engine assembly 12 can operate at a stoichiometric air-to-fuel ratio and/or at an air-to-fuel ratio that is primarily lean of stoichiometry. Although not explicitly portrayed in FIG. 1, it should be appreciated that the vehicle's driveline system may take on any available configuration, including front wheel drive (FWD) layouts, rear wheel drive (RWD) layouts, all-wheel drive (AWD) layouts, four-wheel drive (4WD) layouts, six-by-four (6×4) layouts, etc.

Engine assembly 12 is equipped with a series of reciprocating pistons 16—typically even numbers of 4, 6, 8, etc. arranged in a V-type or I-type configuration—that are slidably movable within cylinder bores 15 of an engine block 13. The top surface of each piston 16 cooperates with the inner periphery of its corresponding cylinder 15 and a respective chamber surface 19 of a cylinder head 25 to define a variable-volume combustion chamber 17. Each piston 16 is connected by a respective piston rod 21 and linkage (e.g., multipoint linkage 102 FIG. 2) to a crankpin of a rotating crankshaft 11. The crankshaft 11, in turn, transforms the linear reciprocating motion of the pistons 16 to rotational motion that is output, for example, as a number of rotations per minute (RPM) to a power transmission (not shown) to drive one or more road wheels 22. The crankshaft 11 is shown packaged within a crankcase 23 mounted underneath the engine block 13. While shown as three discrete parts, the engine block 13, crankcase 23 and/or cylinder head 25 may be integrally formed as single-piece, unitary "monobloc" construction.

An air intake system transmits intake air to the cylinders 15 through an intake manifold 29, which directs and distributes air into the combustion chambers 17 via intake runners of the cylinder head 25. The engine's air intake system has airflow ductwork and various electronic devices for monitoring and regulating incoming air flow. The air intake devices can include, as a first non-limiting example, a mass airflow sensor 32 for monitoring mass airflow (MAF) 53 and intake air temperature (IAT) 55. A throttle valve 34 controls airflow to the engine assembly 12 in response to a control signal (ETC) 57 from a programmable engine control unit (ECU) 5. A pressure sensor 36 in the intake manifold 29 monitors, for instance, manifold absolute pressure (MAP) 59 and barometric pressure.

An optional external flow passage (not shown) recirculates exhaust gases from engine exhaust to the intake manifold 29, employing an exhaust gas recirculation (EGR) valve 38 to meter the volume of recirculated exhaust introduced back into the cylinders 15. The programmable engine control unit 5 controls mass flow of exhaust gas to the intake manifold 29 by controlling opening/closing of the EGR valve 38 via EGR command 61. In FIG. 1, the arrows connecting ECU 5 with the various components of the engine assembly 12 are emblematic of electronic signals or other communication exchanges by which data and/or control commands are transmitted from one component to the other.

Airflow from the intake manifold 29 into the combustion chamber 17 is controlled by one or more intake engine valves 20. Evacuation of exhaust gases out of the combustion chamber 17 to an exhaust manifold 39 is controlled by one or more exhaust engine valves 18. These engine valves 18, 20 are illustrated herein as spring-biased poppet valves; however, other known types of engine valves may be employed. The representative engine assembly's 12 valve train system is equipped to control and adjust the opening and closing of the exhaust and intake engine valves 18, 20. While shown with a single pair of engine valves, it should be appreciated that each cylinder 15 may be equipped with multiple pairs of intake/exhaust engine valves.

According to one example, activation of the exhaust and intake engine valves 18, 20 may be respectively modulated by controlling exhaust and intake variable cam phasing/variable lift control (VCP/VLC) devices. These VCP/VLC devices are electronically modulated to control an intake camshaft and an exhaust camshaft (described below with reference to FIG. 2). Rotation of the intake and exhaust camshafts are linked and indexed to rotation of the crankshaft, thus linking openings and closings of the intake and exhaust valves 20, 18 to positions of the crankshaft 11 and the pistons 16. The intake VCP/VLC device may variably switch and control valve lift of the intake valve(s) 20 in response to a control signal (iVLC) 63, and variably adjust and control phasing of the intake camshaft for each cylinder 15 in response to a control signal (iVCP) 65. In the same vein, the exhaust VCP/VLC device may variably switch and control valve lift of the exhaust valve(s) 18 in response to a control signal (eVLC) 67, and variably adjust and control phasing of the exhaust camshaft for each cylinder 15 in response to a control signal (eVCP) 69. The VCP/VLC devices can be actuated using any one of electro-hydraulic, hydraulic, electro-mechanic, and electric control force, in response to the respective control signals eVLC, eVCP, iVLC, and iVCP.

With continuing reference to the representative configuration of FIG. 1, engine assembly 12 employs a direct-injection fuel injection subsystem with multiple high-pressure electronic fuel injectors 28 that directly inject pulses of fuel into the combustion chambers 17. As shown, each cylinder 15 is provided with one or more fuel injectors 28, which activate in response to an injector pulse width command (INJ_PW) 75 from the ECU 5. These fuel injectors 28 are supplied with pressurized fuel by a fuel distribution system. One or more or all of the fuel injectors 28 can be operable, when activated, to inject multiple fuel pulses—a succession of first, second, third, etc., infusions of fuel mass—per working combustion cycle into a corresponding one of the engine cylinders 15. engine assembly 12 employs a compression-ignition procedure (for diesel engine architectures) or a spark-ignition procedure (for gasoline engine architectures) by which fuel-combustion-initiating energy, such as elevated in-chamber temperatures provided by compressed air or as an abrupt electrical discharge provided via a spark plug 26 in response to a spark command (IGN) 71, ignites cylinder charges in each of the combustion chambers 17. For some applications, the fuel injectors 28 may take on the form of an electronically controlled, common-rail fuel injector architecture that operates, for example, at 2000 bar fuel rail pressure with a normally-off solenoid-driven mode of operation.

The engine assembly 12 is equipped with various sensing devices for monitoring engine operation, including a crank sensor 42 having an output indicative of crankshaft rotational position, e.g., crank angle and/or speed (RPM) signal 43. A temperature sensor 44 monitors, for example, one or more engine-related temperatures (e.g., coolant temp, fuel temp, etc.), and outputs a signal 45 indicative thereof. An in-cylinder combustion sensor 30 monitors combustion-related variables, such as in-cylinder combustion pressure, charge temperature, fuel mass, air-to-fuel ratio, etc., and outputs a signal 31 indicative thereof. An exhaust gas sensor 40 monitors one or more exhaust gas-related variables, e.g., actual air/fuel ratio (AFR), burned gas fraction, etc., and outputs a signal 73 indicative thereof.

The combustion pressure and the crankshaft speed may be monitored by the ECU 5, for example, to determine combustion timing, i.e., timing of combustion pressure relative to the crank angle of the crankshaft 11 for each cylinder 15 for each working combustion cycle. It should be appreciated that combustion timing may be determined by other methods. Combustion pressure may be monitored by the ECU 5 to determine an indicated mean effective pressure (IMEP) for each cylinder 15 for each working combustion cycle. The engine assembly 12 and ECU 5 cooperatively monitor and determine states of IMEP for each of the engine cylinders 15 during each cylinder firing event. Alternatively, other sensing systems may be used to monitor states of other combustion parameters within the scope of the disclosure, e.g., ion-sense ignition systems, EGR fractions, and non-intrusive cylinder pressure sensors.

Figure 2:
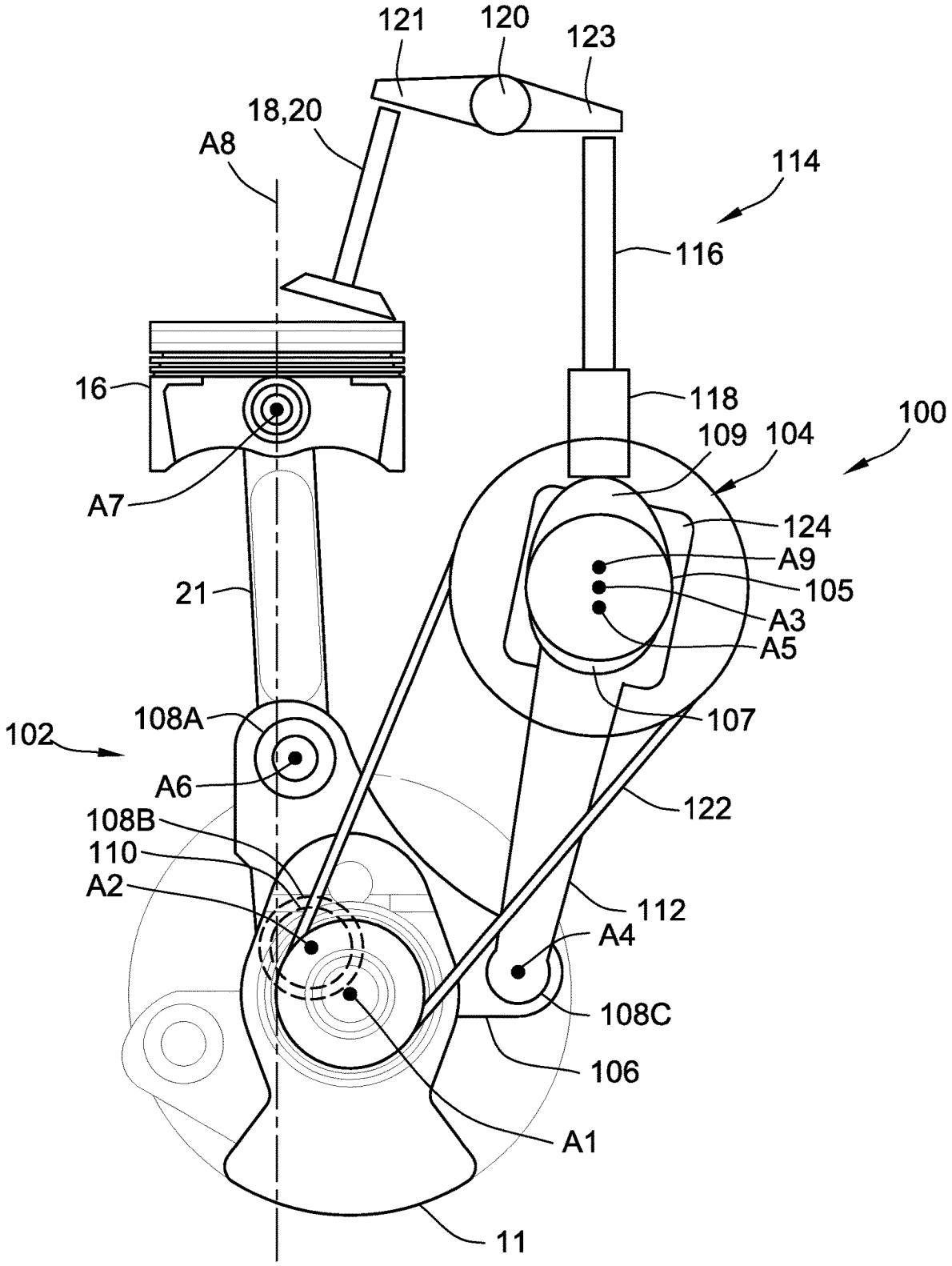
FIG. 2 is a partially schematic illustration of select portions of the VCR/ICE internal combustion engine assembly of FIG. 1 showing a multilink cranktrain system with a cranktrain control shaft for combined eccentric system and valve train system control in accord with aspects of the disclosed concepts.

Turning next to FIG. 2, there is shown a representative multilink cranktrain system 100 with shared control shaft for combined eccentric system and valve train system control to enable VCR/ICE operation of the engine assembly 12. The multilink cranktrain system 100 is represented in FIG. 2 by a multipoint linkage assembly 102 and a cranktrain control shaft 104. Each multipoint linkage assembly 102 drivingly engages a respective one of the pistons 16 to the crankshaft 11. The multipoint linkage assembly 102 includes a triangular-shaped linkage body 106 that may be machined, cast or molded as a single-piece, unitary construction. The linkage body 106, which is packaged inside the engine block 13 and/or crankcase 23, is rotatably mounted onto a respective crankpin 110 of the crankshaft 11.

With this arrangement, the crankshaft 11 is rotatable on a first (crank) axis A1 that extends longitudinally through the radial center of the crankshaft 11. The linkage body 106, in contrast, is rotatable on a second (link) axis A2 that extends through the center of the crankpin 110 and is radially offset/spaced from, yet is substantially parallel to, the first axis A1. Located inside the engine block 13, laterally adjacent the cylinder bore 15, is a cranktrain control shaft 104 that rotates on a third (control) axis A3 that extends longitudinally through the radial center of the control shaft's 104 main body 105. The third axis A3 of the control shaft 104 is horizontally and vertically offset/spaced from, yet is substantially parallel to, the first and second axes A1, A2 of the crankshaft 11 and linkage body 106.

Located at the three corners of the triangular-shaped linkage body 106 are discrete coupling sockets, namely three rotation joints 108A, 108B and 108C for interconnecting with the crankshaft 11, piston 16 and control shaft 104. As best seen in FIG. 2, the first rotation joint 108A rotatably couples the linkage body 106 to the piston 16 via a piston connecting rod 21. Rotatable coupling of the piston connecting rod 21 to the linkage body 106 and piston 16 may be achieved by any suitable means, including gudgeon pins, plain bearings, roller bearings, bushings, etc. Likewise, the second rotation joint 108B rotatably couples the linkage body 106 onto the crankpin 110 of crankshaft 11, e.g., via a rod end bearing (a "helm joint"). Lastly, the third rotation joint 108C rotatably couples the linkage body 106 to the cranktrain control shaft 104 via a tie-link connecting rod 112. Rotatable coupling of the tie-link connecting rod 112 to the linkage body 106 and control shaft 104 may be achieved, for example, through any of the techniques described above with respect to the piston rod 21.

Similar to the crankshaft 11, the cranktrain control shaft 104 of FIG. 2 is rotatably supported by the engine block 13; the control shaft 104, however, is located inside the cylinder case section of the block 13, above the crankshaft 11 and crankcase 23. According to the illustrated example, the first and second axes A1, A2 are both located underneath the cylinder bore 15 and piston 16, whereas the third axes A3 is laterally offset from the cylinder bore 15, located closest to the cylinder head 25 of the three axes A1-A3. The cranktrain control shaft 104 is generally composed of an elongated and cylindrical main shaft body 105 with a series of longitudinally spaced eccentric lobes 107 (e.g., one lobe per piston) that project radially outward from body 105. In addition, a series of longitudinally spaced roller cams 109 (e.g., one cam per valve or valve pair) that project radially outward from body 105. The circular-shaped lobes 107 and oblong-shaped cams 109 are integrally formed with or rigidly attached to the main shaft body 105 to rotate in unison therewith.

During engine operation, the cranktrain control shaft 104 selectively rotates the linkage body 106 of the multipoint linkage assembly 102 on the crankshaft 11 and, at the same time, unseats and reseats the engine valve 18, 20 from within the combustion chamber in unison with the rotating crankshaft 11. With continuing reference to FIG. 2, a first (bottom) end of each tie-link connecting rod 112 is rotatably coupled to the third rotation joint 108C of one of the linkage bodies 106 such that the tie-link rod 112 rotates on a fourth (bottom tie) axis A4. A second (top) end of each tie-link connecting rod 112, on the other hand, is rotatably coupled to a respective one of the eccentric lobes 107 to rotate on a fifth (top tie) axis A5 that is spaced radially outward from the third axis A3. Both the fourth and fifth axes A4, A5 are offset from the rotational axes A1-A3 of the crankshaft 11, linkage body 106 and control shaft 104.

Similar to the tie-link connecting rod 112, a first (bottom) end of each piston connecting rod 21 is rotatably coupled to the first rotation joint 108A of one of the linkage bodies 106 such that the piston rod 21 rotates on a sixth (bottom rod) axis A6. A second (top) end of each piston connecting rod 21, on the other hand, is rotatably coupled to a respective piston 16 to rotate on a seventh (top rod) axis A7. Both the sixth and seventh axes A6, A7 are offset from the rotational axes A1-A3 of the crankshaft 11, linkage body 106 and control shaft 104. As best seen in FIG. 2, the piston 16 reciprocates rectilinearly upward-and-downward along a center axis A8 of the cylinder bore 16; this center axis A8 is laterally offset from and, thus, does not intersect the first and third axes A1, A3.

With this arrangement, rotation of the control shaft 104 in a first direction (e.g., clockwise in FIG. 2) will rotate the eccentric lobe 107, causing a reciprocating (up-down) linear motion of the tie-link connecting rod 112. Reciprocating movement of the tie-link connecting rod 112 causes the linkage body 106 to rotate back-and-forth on the crankpin 110 of the crankshaft 11. Rotating the linkage body 106 on the crankshaft 11 concomitantly changes the radial distance between the piston 16 and crankpin 110. Changing the distance between the piston 16 and crankpin 110 concurrently varies the stroke length of the piston 16 during rotation of the crankshaft 11.

In tandem with the selective control of piston stroke length, the cranktrain control shaft 104 also governs operation of one or more valve assemblies 114 to control fluid intake and/or evacuation for the combustion chamber. A non-limiting example of a "pushrod style" valve assembly 114 is represented in FIG. 2 by a spring-biased poppet valve 18, 20, a pushrod 116, a cam follower 118, and a rocker assembly 120. The rocker assembly 120 is pivotably mounted within the engine block 13 or cylinder head 25, and may take on any suitable form, including guide plate-type rocker arms, stud-mounted rocker arms, slider-type rocker arms, etc. A first (left) rocker arm 121 of the pivotably mounted rocker 120 sits on the distal tip of the stem of the valve 18, 20. The cam follower 118, which may be in the nature of a hydraulic lash adjuster, mechanical lifter, or roller tappet, is secured to a first (bottom) end of the pushrod 116 and seated against one of the roller cams 109 of the control shaft 104. A second (top) end of the pushrod 116 abuts against and, optionally, is fixedly attached to a second (right) rocker arm 123.

Rotation of the cranktrain control shaft 104 about the central control axis A3 causes the roller cam 109 to rotate with a cam center A9, which is radially displaced from and rotates around the main body 105. Rotation of the roller cam 109 transforms rotary motion of the control shaft 104 into a reciprocating (up-down) linear motion of the pushrod 116. Each time the pushrod 116 translates away from the control shaft 104 (upward in FIG. 2), the pushrod 116 pushes against the rocker arm 123. This causes the rocker assembly 120 to pivot until the rocker arm 121 presses down on the valve 18, 20, causing the valve 18, 20 to unseat and thereby allow air/exhaust to enter/exit the combustion chamber.

Rotation of the cranktrain control shaft 104 may be enabled by indexed coupling of the control shaft 104 to the crankshaft 11. In FIG. 2, a representative control shaft drive system is portrayed as a belt drive system 122 that drivingly connects the crankshaft 11 with the control shaft 104 such that rotation of the crankshaft 11 causes in-phase or out-of-phase rotation of the control shaft 104. For at least some applications, the cranktrain control shaft 104 may run at half crankshaft speed to enable eccentric shaft drive and camshaft drive operations via a single control shaft 104. It should be appreciated that other mechanical drive systems may be used in addition to or as an alternative for belt drive systems, including gear train systems, chain drive systems, roller train systems, etc. An optional phasing device 124 is mounted within the engine block 13 and connected to the control shaft 104. The phasing device 124 selectively changes the rotational speed of the control shaft 104 relative to the crankshaft 11 to thereby change the stroke length of the piston 16. The phasing device 124 may be constructed in any logically suitable configuration, including a motor-controlled gear box phaser or a hydraulic-controlled vane phaser.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined by the appended claims. Moreover, the present concepts expressly include any and all combinations and subcombinations of the preceding elements and features.

What is claimed:

1. An engine assembly comprising:

an engine block defining therein a combustion chamber with a cylinder bore;

a valve assembly fluidly coupled to the combustion chamber and operable to selectively unseat to thereby introduce or evacuate a fluid from the combustion chamber;

a piston reciprocally movable within the cylinder bore;

a crankshaft rotatably supported by the engine block and rotatable on a first axis;

a multipoint linkage drivingly engaging the piston to the crankshaft and rotatable on a second axis offset from the first axis; and a control shaft rotatably supported by the engine block and rotatable on a third axis offset from the first and second axes, wherein the control shaft is coupled to and operable to selectively rotate the multipoint linkage on the second axis, and the control shaft is coupled to and operable to selectively unseat the valve assembly.

2. The engine assembly of claim 1, further comprising a cylinder head attached to the engine block, the cylinder head cooperatively defining the combustion chamber with the cylinder bore, wherein the first, second and third axes are mutually parallel and the third axis is located closest to the cylinder head.

3. The engine assembly of claim 1, wherein the multipoint linkage includes a linkage body with first, second, and third rotation joints, the first rotation joint rotatably coupling to the piston, the second rotation joint rotatably coupling to the crankshaft, and the third rotation joint rotatably coupling to the control shaft.

4. The engine assembly of claim 3, wherein the first rotation joint rotatably couples to the piston via a connecting rod, the second rotation joint rotatably couples to a crankpin of the crankshaft via a rod bearing, and the third rotation joint rotatably couples to the control shaft via a tie-link rod.

5. The engine assembly of claim 4, wherein the control shaft includes an eccentric lobe projecting radially outward from a main shaft body, and wherein a first end of the tie-link rod is rotatably coupled to the third rotation joint of the multipoint linkage to rotate on a fourth axis, and a second end of the tie-link rod is rotatably coupled to the eccentric lobe to rotate on a fifth axis offset from the first, second and third axes.

6. The engine assembly of claim 4, wherein a first end of the connecting rod is rotatably coupled to the first rotation joint of the multipoint linkage to rotate on a sixth axis, and a second end of the connecting rod is rotatably coupled to the piston to rotate on a seventh axis offset from the first, second and third axes.

7. The engine assembly of claim 4, wherein the first axis is defined through the center of the crankshaft, the second axis is defined through the center of the second rotation joint and the crankpin, and the third axis is defined through the center of the control shaft.

8. The engine assembly of claim 1, wherein the control shaft includes a roller cam projecting radially outward from a main shaft body, and wherein the valve assembly includes a spring-biased valve fluidly coupled to the combustion chamber and a pushrod coupled to the roller cam.

9. The engine assembly of claim 8, wherein the valve assembly further includes a pivotable rocker assembly and a hydraulic lifter, the pivotable rocker assembly having a first rocker arm abutting a stem of the spring-biased valve and a second rocker arm abutting a first end of the pushrod, and the hydraulic lifter attached to a second end of the pushrod and seated against the roller cam.

10. The engine assembly of claim 1, wherein the piston reciprocates rectilinearly along a center axis of the cylinder bore, the center axis being offset from and not intersecting the first and third axes.

11. The engine assembly of claim 1, further comprising a phasing device mounted within the engine block and connected to the control shaft, the phasing device being operable to selectively change a rotational speed of the control shaft relative to the crankshaft to thereby change a stroke length of a compression stroke of the piston.

12. The engine assembly of claim 1, further comprising a gear train system or a belt drive system drivingly connecting the crankshaft with the control shaft such that rotation of the crankshaft causes out-of-phase rotation of the control shaft.

13. A motor vehicle comprising:

a vehicle body;

multiple road wheels mounted to the vehicle body; and an internal combustion engine (ICE) assembly mounted to the vehicle body and operable to drive one or more of the road wheels to thereby propel the motor vehicle, the ICE assembly including:

an engine block defining therein a combustion chamber with a cylinder bore;

a valve assembly fluidly coupled to the combustion chamber and operable to selectively unseat to thereby introduce or evacuate a fluid from the combustion chamber;

a piston reciprocally movable within the cylinder bore;

a crankshaft rotatably supported by the engine block and rotatable on a first axis;

a multipoint linkage drivingly engaging the piston to the crankshaft and rotatable on a second axis offset from the first axis; and a control shaft rotatably supported by the engine block and rotatable on a third axis offset from the first and second axes, wherein the control shaft is coupled to and operable to selectively rotate the multipoint linkage on the second axis, and the control shaft is coupled to and operable to selectively unseat the valve assembly.

14. A method of manufacturing an engine assembly, the method comprising:

receiving an engine block defining therein a combustion chamber with a cylinder bore;

attaching a valve assembly to the engine block, the valve assembly being fluidly coupled to the combustion chamber and operable to selectively unseat to thereby introduce or evacuate a fluid from the combustion chamber;

attaching a piston to the engine block to move reciprocally within the cylinder bore;

attaching a crankshaft to the engine block to rotate on a first axis;

attaching a multipoint linkage to the engine block, the multipoint linkage drivingly engaging the piston with the crankshaft and rotating on a second axis offset from the first axis;

attaching a control shaft to the engine block, the control shaft rotating on a third axis offset from the first and second axes;

coupling the control shaft to the multipoint linkage, the control shaft being operable to selectively rotate the multipoint linkage on the second axis; and coupling the control shaft to the valve assembly, the control shaft being operable to selectively unseat the valve assembly.

15. The method of claim 14, further comprising attaching a cylinder head to the engine block, the cylinder head cooperatively defining the combustion chamber with the cylinder bore, wherein the first, second and third axes are mutually parallel and the third axis located closest to the cylinder head.

16. The method of claim 14, wherein the multipoint linkage includes a linkage body with first, second, and third rotation joints, the first rotation joint rotatably coupling to the piston, the second rotation joint rotatably coupling to the crankshaft, and the third rotation joint rotatably coupling to the control shaft.

17. The method of claim 16, wherein the first rotation joint rotatably couples to the piston via a connecting rod, the second rotation joint rotatably couples to a crankpin of the crankshaft via a rod bearing, and the third rotation joint rotatably couples to the control shaft via a tie-link rod.

18. The method of claim 17, wherein the control shaft includes an eccentric lobe projecting radially outward from a main shaft body, and wherein a first end of the tie-link rod is rotatably coupled to the third rotation joint of the multipoint linkage to rotate on a fourth axis, and a second end of the tie-link rod is rotatably coupled to the eccentric lobe to rotate on a fifth axis offset from the first, second and third axes.

19. The method of claim 14, wherein the control shaft includes a roller cam projecting radially outward from a main shaft body, and wherein the valve assembly includes a spring-biased valve fluidly coupled to the combustion chamber and a pushrod coupled to the roller cam.

20. The method of claim 14, further comprising attaching a gear train system or a belt drive system to the engine block, the gear train system or belt drive system drivingly connecting the crankshaft with the control shaft such that rotation of the crankshaft causes out-of-phase rotation of the control shaft.

* * * * *